US009449744B2

(12) United States Patent
Lee et al.

(10) Patent No.: US 9,449,744 B2
(45) Date of Patent: Sep. 20, 2016

(54) MAGNETO-RHEOLOGICAL FLUID COMPOSITION

(71) Applicants: Hyundai Motor Company, Seoul (KR); Klueber Lubrication Korea Ltd., Seoul (KR)

(72) Inventors: Sung Uk Lee, Chungcheongnam-Do (KR); Jong Min Park, Incheon (KR); Dae Yun Bae, Gyeonggi-Do (KR); Jin Young Lee, Gyeongsangbuk-Do (KR)

(73) Assignees: Hyundai Motor Company, Seoul (KR); Klueber Lubrication Korea Ltd., Seoul (KR)

( * ) Notice: Subject to any disclaimer, the term of this patent is extended or adjusted under 35 U.S.C. 154(b) by 102 days.

(21) Appl. No.: 14/569,692

(22) Filed: Dec. 13, 2014

(65) Prior Publication Data

US 2015/0228389 A1 Aug. 13, 2015

(30) Foreign Application Priority Data

Feb. 11, 2014 (KR) ..... 10-2014-0015319

(51) Int. Cl.
*H01F 1/44* (2006.01)

(52) U.S. Cl.
CPC ..... *H01F 1/447* (2013.01)

(58) Field of Classification Search
CPC ..... H01L 1/447
See application file for complete search history.

(56) References Cited

U.S. PATENT DOCUMENTS 5,989,447 A * 11/1999 Podszun ..... H01F 1/447 252/62.52

FOREIGN PATENT DOCUMENTS

| | | | |
|---|---|---|---|
| CN | 101139504 | | 3/2008 |
| CN | 101967421 | | 2/2011 |
| KR | 10-2002-0064654 | | 8/2002 |
| KR | 10-0734333 | | 6/2007 |
| KR | 10-2009-0107257 | | 10/2009 |
| KR | 10-2010-0081799 | | 7/2010 |
| KR | 10-1074192 | A | 10/2011 |
| WO | 2007/003580 | A1 | 1/2007 |
| WO | 2008/055645 | A2 | 5/2008 |
| WO | WO 2008/147080 | * | 12/2008 |

* cited by examiner

*Primary Examiner* — Carol M Koslow
(74) *Attorney, Agent, or Firm* — Mintz Levin Cohn Ferris Glovsky and Popeo, P.C.; Peter F. Corless

(57) ABSTRACT

Disclosed is a magneto-rheological fluid composition which comprises magnetic particles, a fluid, a dispersant, a structure stabilizer and an anti-friction additive. Particularly, the magnetic particles include non-coated magnetic particles and polyvinyl butyral-coated magnetic particles at the weight ratio of about 1:1 to 4:1. Accordingly, dispersion stability and yield stress are improved substantially when magnetic field is applied to the magneto-rheological fluid.

10 Claims, No Drawings

MAGNETO-RHEOLOGICAL FLUID COMPOSITION

CROSS-REFERENCE TO RELATED APPLICATION

This application claims under 35 U.S.C. §119(a) the benefit of Korean Patent Application No. 10-2014-0015319 filed on Feb. 11, 2014, the entire contents of which are incorporated herein by reference.

TECHNICAL FIELD

The present invention relates to a magneto-rheological fluid composition. Particularly, the magneto-rheological fluid composition comprises: magnetic particles, a fluid, a dispersant, a structure stabilizer and an anti-friction additive, and the magnetic particles include non-coated magnetic particles and polyvinyl butyral-coated magnetic particles at the weight ratio of about 1:1 to 4:1. Accordingly, the magnetic particles may be dispersed substantially in the fluid by containing the polymer-coated magnetic particles so as to have improved dispersion stability and shear stress when external magnetic field is applied.

BACKGROUND

Magneto-rheological fluid is one of intelligent materials. For example, viscosity of the magneto-rheological fluid may reversibly change according to intensity of externally applied magnetic field. In general, the magneto-rheological fluid refers to a non-colloidal suspension which includes micro-particles made of iron, nickel and cobalt having diameter of about several to tens of micron. The magnetic alloy particles may be dispersed in a dispersion media or fluid such as mineral oil, synthetic hydrocarbon, water, silicon oil, esterified fatty acid, and the like.

The magneto-rheological fluid has a dynamic range of rheological properties such as fluid viscosity characteristic when magnetic field is applied, and has substantial durability. In addition, the magneto-rheological fluid may be less influenced by contaminants, but it responds rapidly and reversibly to the magnetic field, for example, in about 10 sec. Therefore, the magneto-rheological fluid may have desirable applicability to various industrial fields such as vibration control system, for example, vehicle clutch, engine mount and damper, seismic device of high rise building, driving device such as robotic system. Further, compared to another controllable fluid such as electro-rheological fluid, the magneto-rheological fluid may be remarkably beneficial.

The magneto-rheological fluid, in general, has characteristics of newton fluid when magnetic field is not applied. However, when magnetic field is applied, dispersed magnetic particles form dipoles and thus form a fibrous structure aligned in a direction parallel to the applied magnetic field. Accordingly, the fibrous structure formed in the fluid increases viscosity, the increased viscosity provides shearing force which inhibits flow of the fluid or resistance to flow, thereby substantially increasing dynamic yield stress. The yield stress increases according to the magnetic field intensity applied to the fluid.

For efficient use of the magneto-rheological fluid, the magneto-rheological fluid may be required to have high yield stress and magnetic particles included in the magneto-rheological fluid are desired to be evenly distributed in a dispersion media. Further, fluid viscosity may be required to be low enough to readily return the fluid of its original state if applied magnetic field disappears. Moreover, the magneto-rheological fluid needs to have constant rheological characteristics with little change in viscosity in various temperature ranges. However, the magneto-rheological fluid may be greatly influenced on rheological behavior by sedimentation caused by gravity. In particular, the sedimentation occurs due to density differences between the magnetic particle and the dispersion media. For example, the typical magneto-rheological fluid has a density of about 7.86 g/cm$^3$ which is much greater than density of the dispersive media of about 0.5 to 3 g/cm$^3$. Therefore, the magnetic particle may form sedimentation in the dispersion media. Due to such sedimentation of the magnetic particles, dispersion stability of the magneto-rheological fluid may not be obtained.

In the related arts, a magneto-rheological fluid in which hydrophilic surfactant is adsorbed on magnetic particles on the water/oil emulsion surface and the magnetic particles are dispersed and a method manufacturing thereof have been developed. However, when using the hydrophilic surfactant-adsorbed magnetic particle, corrosion of magnetic particles may occur and boiling point of the magneto-rheological fluid may decrease due to characteristics of water/oil emulsion as a dispersion media.

In other examples of the related arts, a magneto-rheological fluid has been disclosed and the magneto-rheological fluid has improved dispersion stability and heat-resistance, high yield stress when applying magnetic field, low viscosity change in various temperature ranges, improved sedimentation stability and re-dispersibility. The magneto-rheological fluid may include a dispersion media comprising a mixture of hydrogenated hydrocarbon oil manufactured from mineral oil by hydrogenation and ester in a weight ratio of about 2:8 to 8:2. However, shear force thereof does not shown a satisfactory level of stress.

As such, development of a novel magneto-rheological fluid composition has been desired to prove improved dispersion stability and high shear stress.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention provides technical solutions to the above-described problems associated with the related arts, and provides a magneto-rheological fluid composition having improved dispersion stability and shear stress when external magnetic field is applied to the magneto-rheological fluid.

In one aspect, the present invention provides a magneto-rheological fluid composition comprising magnetic particles, a fluid, a dispersant, a structure stabilizer and an anti-friction additive. The magnetic particle may be prepared by mixing non-coated magnetic particles and polyvinyl butyral-coated magnetic particles at the weight ratio of about 1:1 to 4:1.

In an exemplary embodiment, the magneto-rheological fluid composition may comprise:

the magnetic particles including non-coated magnetic particles and polyvinyl butyral-coated magnetic particles at the weight ratio of about 1:1 to 4:1 in an amount of about 55 to 85 wt %;

the fluid in an amount of about 10 to 40 wt %, based on the total weight of the magneto-rheological fluid composition;

the dispersant in an amount of about 0.1 to 2.0 wt %, based on the total weight of the magneto-rheological fluid composition;

the structure stabilizer in an amount of about 0.1 to 2.0 wt %, based on the total weight of the magneto-rheological fluid composition; and the anti-friction additive in an amount of about 1 to 5.0 wt %, based on the total weight of the magneto-rheological fluid composition.

In certain exemplary embodiments, an average particle size of the magnetic particles may be of about 1 to 10 μm, and the magnetic particles may contain iron (Fe) in an amount of 97 wt % or greater based on the total weight of the magnetic particles.

In certain exemplary embodiments, the fluid may be at least one selected from the group consisting of ester oil, mineral oil, synthetic hydrocarbon oil and silicon oil. In yet certain exemplary embodiments, the fluid may have a kinematic viscosity of about 5 to 50 $m^2/s$ at a temperature of about 40° C.

In certain exemplary embodiments, the dispersant may be alkyl ammonium salt.

In certain exemplary embodiments, the structure stabilizer may be modified urea.

In certain exemplary embodiments, the anti-friction additive may be at least one selected from the group consisting of molybdenum disulfide, zinc phosphate, triaryl phosphate, triphenyl phosphorothionate and amine phosphate.

In another exemplary embodiment, the magneto-rheological fluid composition may further comprise an antioxidant, an anticorrosive agent, an antirust agent or combinations thereof.

Other aspects and preferred embodiments of the invention are discussed infra.

DETAILED DESCRIPTION

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about".

As used here, the term "settleability" refers to a dispersion property of a fluid, in particular a magnetic-rheological fluid. The settleability in the present disclosure may be directed to a degree of dispersion stability which prevents sedimentation in the fluid. In certain embodiments of the present invention, the settleability may be obtained in % by dividing a volume of settled the magneto-rheological fluid after a certain period of time with the total volume of the original magnetic rheological fluid. For example, if the sedimentation of the magneto-rheological fluid including the magnetic particles occurs or the particles are packed as sediment, the settleability decreases substantially. Otherwise, if the magneto-rheological fluid does not form sedimentation and maintain original dispersion state or dispersion stability, the settleability may not decrease and may be close to 100%. The optimal range of the settleability for the magnetic-rheological fluid in the present invention may be about 95% or greater.

Hereinafter reference will now be made in detail to various embodiments of the present invention. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

In one aspect, the magneto-rheological fluid composition of the present invention may include magnetic particles, a fluid, a dispersant, a structure stabilizer and an anti-friction additive. In particular, the magnetic particle may include non-coated magnetic particles and polyvinyl butyral-coated magnetic particles at the weight ratio of about 1:1 to 4:1.

In an exemplary embodiment of the present invention, the magneto-rheological fluid composition may include: an amount of about 55 to 85 wt % of the magnetic particles including non-coated magnetic particles and polyvinyl butyral-coated magnetic particles at the weight ratio of 1:1 to 4:1; an amount of about 10 to 40 wt % of the fluid; an amount of about 0.1 to 2.0 wt % of the dispersant; an amount of about 0.1 to 2.0 wt % of the structure stabilizer; and an amount of about 1 to 5.0 wt % of anti-friction additive.

The magnetic particles, as use herein, may be made by mixing non-coated magnetic particles and polyvinyl butyral-coated magnetic particles at the weight ratio of about 1:1 to 4:1. The average particles size of the magnetic particles may be in a range of about 1 to 10 μm, and may contain iron (Fe) in an amount of about 97 wt % or greater based on the total weight of the magnetic particles. The iron included in the magnetic particle may be, but not limited to, carbonyl iron.

The polyvinyl butyral is a polymer material having rubber-like properties and polymer properties, and thus the polyvinyl butyral has been broadly used in outer walls of a building, ceilings, floors, internal windows, show windows, display stands and the like. The polyvinyl butyral-coated magnetic particle, as used herein, may improve dispersion stability of magneto-rheological fluid by preventing sedimentation of the magnetic particles. When the non-coated particles and the polyvinyl butyral-coated magnetic particles are mixed at the ratio of about 1:1 or less, shear stress may be reduced. When the ratio is greater than about 4:1, shear stress may be improved but the particles in the fluid may sediment substantially due to reduced dispersion as the amount of the polyvinyl butyral-coated magnetic particles is reduced, and dispersion stability may be reduced, thereby settleability may be reduced. Thus, the magnetic particles may be mixed within the above range.

Further, the average particles size of the magnetic particles may be in a range of about 1 to 10 μm. When the particle size is less than about 1 μm, shear stress may be reduced. When it is greater than about 10 μm, dispersibility and settleability may be reduced. Thus, the magnetic particles may have the average size within the above range.

In addition, the magnetic particles may be included in an amount of about 55 to 85 wt % based on total weight of the magneto-rheological fluid composition. When the amount of the magnetic particles is less than about 55 wt %, shear stress may be reduced, and settleability may be reduced due to reduced amount of the polyvinyl butyral-coated magnetic particles. When the amount of the magnetic particles is greater than about 85 wt %, fluidity may be reduced. Thus, the magnetic particles may be included within the above range.

Then, the fluid may be at least one selected from the group consisting of ester oil, mineral oil, synthetic hydrocarbon oil and silicon oil. In particular, the fluid may have a kinematic viscosity of about 5 to 50 $m^2/s$ at a temperature of about 40° C., preferably. When the kinematic viscosity is less than 5 $m^2/s$, settleability may be reduced. When the kinematic viscosity is greater than about 50 $m^2/s$, fluidity may be reduced and shear stress may be substantially elevated. Thus, fluid having physical properties within the said range may be used.

Further, the fluid may be included in an amount of about 10 to 40 wt % based on total weight of the magneto-rheological fluid composition. When the amount of the fluid is less than about 10 wt %, uniform particle distribution may not be obtained and fluidity may be reduced.

When the amount of the fluid is greater than about 40 wt %, rheological properties may be reduced and settleability may be reduced. Thus, the fluid may be included within the above range.

The dispersant, as used herein, may be alkyl ammonium salt-type, and the dispersant may be included in an amount of about 0.1 to 2.0 wt % based on total weight of the magneto-rheological fluid composition. When the amount of the dispersant is less than about 0.1 wt %, settleability or dispersion stability may not be improved sufficiently. When the amount of the dispersant is greater than about 2.0 wt %, shear stress may be reduced. Thus, the dispersant may be included within the above range.

The structure stabilizer, as used herein, may be a modified urea, and the structure stabilizer may be included in amount of about 0.1 to 2.0 wt % based on total weight of the magneto-rheological fluid composition. When the amount of the structure stabilizer is less than about 0.1 wt %, settleability or dispersion stability may not be improved sufficiently. When the amount of the structure stabilizer is greater than about 2.0 wt %, settleability may be reduced. Thus, the structure stabilizer may be included within the above range.

Then, the anti-friction additive may be at least one selected from the group consisting of molybdenum disulfide, zinc phosphate, triaryl phosphate, triphenyl phosphorothionate and amine phosphate, and the anti-friction additive may be included in an amount of about 1 to 5.0 wt % based on total weight of the magneto-rheological fluid composition. When the amount of the anti-friction additive is less than about 1 wt %, friction resistance may not be improved sufficiently. When the amount of the anti-friction additive is greater than about 5 wt %, friction resistance may not be further improved in accordance with the amount. Thus, the anti-friction additive may be included within the above range.

In addition, the magneto-rheological fluid composition according to the present invention may further comprise an antioxidant, an anticorrosive agent, an antirust agent or combinations thereof.

According to various exemplary embodiments of the present invention, the magneto-rheological fluid composition including magnetic particles which is made by mixing non-coated magnetic particles and polyvinyl butyral-coated magnetic particles at the weight ratio of about 1:1 to 4:1 may have improved dispersion stability as the magnetic particles may be substantially dispersed in the fluid, and may have improved shear stress when external magnetic field is applied,.

EXAMPLES

The following examples illustrate the invention and are not intended to limit the same.

Preparative Example

Preparation of Polyvinyl Butyral-Coated Magnetic Particle

Polyvinyl butyral was completely dissolved in acetone and octylphenol ethylene oxide polymer as a surfactant was added thereto. Subsequently, water, isopropyl alcohol-type surfactant and carbonyl iron powder were mixed, and the acetone solution including the polyvinyl butyral as prepared above was slowly added to the mixed solution. While checking the formation of emulsion or precipitation of polyvinyl butyral, the resulting solution was stirred at about 500 rpm for about 24 hours using a stirrer until acetone was completely evaporated. The obtained polyvinyl butyral-coated carbonyl iron particles were filtered, washed with water and then air dried.

Reference Comparative Examples 1 to 11

A mixture of alkyl ammonium salt-type dispersant and modified urea structure stabilizer were prepared in ester oil, which has a kinematic viscosity of about 30 $m^2/s$ at about 40° C. according to the compositions shown in Table 1. The prepared mixtures were stirred at about 1000 rpm for about 5 min using a homogenizer. Conventional magnetic particles were added to each resulting homogenized ester oil mixture and each resulting solution was stirred again at about 1000 rpm for about 60 min to obtain each magneto-rheological fluid.

TABLE 1

| Kind | Comparative Examples | | | | | | | | | | |
|---|---|---|---|---|---|---|---|---|---|---|---|
| (wt %) | 1 | 2 | 3 | 4 | 5 | 6 | 7 | 8 | 9 | 10 | 11 |
| Magnetic Particle | 65.0 | 85.0 | 85.0 | 85.0 | 85.0 | 45.0 | 95.0 | 85.0 | 85.0 | 85.0 | 85.0 |
| Fluid | 32.0 | 12.0 | 11.5 | 11.5 | 12.5 | 52.0 | 2.0 | 13.0 | 13.0 | 10.5 | 10.5 |
| Dispersant | 1.0 | 1.0 | 1.5 | 1.0 | 0.5 | 1.0 | 1.0 | 1.0 | 0.0 | 1.0 | 2.5 |

TABLE 1-continued

| Kind | Comparative Examples | | | | | | | | | | |
|---|---|---|---|---|---|---|---|---|---|---|---|
| (wt %) | 1 | 2 | 3 | 4 | 5 | 6 | 7 | 8 | 9 | 10 | 11 |
| Structure Stabilizer | 1.0 | 1.0 | 1.0 | 1.5 | 1.0 | 1.0 | 1.0 | 0.0 | 1.0 | 2.5 | 1.0 |
| Anti-friction Additive | 1.0 | 1.0 | 1.0 | 1.0 | 1.0 | 1.0 | 1.0 | 1.0 | 1.0 | 1.0 | 1.0 |
| Total | 100 | 100 | 100 | 100 | 100 | 100 | 100 | 100 | 100 | 100 | 100 |

Fluid: Ester oil
Magnetic particle: Carbonyl iron powder (BASF) having an average particle size of about 5 μm
Dispersant: Alkylammonium
Structure stabilizer: Modified urea
Anti-friction additive: Molybdenum species

Examples 1 to 3 and Comparative Examples 1 to 3

A mixture of alkyl ammonium salt dispersant and modified urea structure stabilizer were prepared in ester oil, which has a kinematic viscosity of about 30 $m^2/s$ at about 40° C. according to the compositions in Table 2. The prepared mixtures were stirred at about 1000 rpm for about 5 min using a homogenizer. The polyvinyl butyral-coated magnetic particles prepared above in Preparation Example and non-coated magnetic particles were added to each resulting homogenized ester oil mixture. Then, each resulting solution was stirred again at about 1000 rpm for about 60 min to obtain magneto-rheological fluid.

TABLE 2

| Kind | Examples | | | Comparative Examples | | |
|---|---|---|---|---|---|---|
| (wt %) | 1 | 2 | 3 | 1 | 2 | 3 |
| Magnetic Particle (non-coated) | 42.5 | 59.5 | 68.0 | 25.5 | 34.0 | 76.5 |
| Magnetic Particle (coated) | 42.5 | 25.5 | 17.0 | 59.5 | 51.0 | 8.5 |
| Fluid | 12.5 | 12.5 | 12.5 | 12.5 | 12.5 | 12.5 |
| Dispersant | 0.5 | 0.5 | 0.5 | 0.5 | 0.5 | 0.5 |
| Structure Stabilizer | 1.0 | 1.0 | 1.0 | 1.0 | 1.0 | 1.0 |
| Anti-friction Additive | 1.0 | 1.0 | 1.0 | 1.0 | 10 | 1.0 |
| Total | 100 | 100 | 100 | 100 | 100 | 100 |

Fluid: Ester oil
Magnetic particle: Carbonyl iron powder (BASF) having an average particle size of about 5 μm
Dispersant: Alkyl ammonium
Structure stabilizer: Modified urea
Anti-friction additive: Molybdenum species

Test Example 1

Characteristics of the magneto-rheological fluids prepared in the above Reference Comparative Examples 1 to 11, Examples 1 to 3 and Comparative Examples 1 to 3 were measured as described below, and the results are shown in Table 3 and Table 4.

(1) Settleability (%) measurement: the volume of settled magneto-rheological fluid was measured after 2 weeks from preparation. The measured volume was divided by the initial total magneto-rheological fluid volume to present in percentage.

(i.e., Settleability (%)=volume of settled magneto-rheological fluid/Total volume of magneto-rheological fluid×100)

(2) rheological properties (Unit: Pa·s) measurement: apparent viscosity change depending on shear rate under magnetic field of about 0.3 T was measured using a rheometer (Anton Paar: Physica MCR 301, MRD 170/1T).

TABLE 3

| | Reference Comparative Examples | | | | | | | | | | |
|---|---|---|---|---|---|---|---|---|---|---|---|
| Kind | 1 | 2 | 3 | 4 | 5 | 6 | 7 | 8 | 9 | 10 | 11 |
| Rheological Properties (Unit: Pa · S) | 472.9 | 485.6 | 482.8 | 491.6 | 487.5 | 273.9 | Hardened (Unable to measure) | 469.5 | 481.4 | 473.3 | 453.7 |
| Settleability (%) | 91.0 | 92.5 | 93.0 | 92.0 | 92.0 | 68.5 | 99.0 | 74.0 | 71.0 | 73.0 | 76.0 |

TABLE 4

| Kind (wt %) | Objected standard | Examples 1 | Examples 2 | Examples 3 | Comparative Examples 1 | Comparative Examples 2 | Comparative Examples 3 |
|---|---|---|---|---|---|---|---|
| Rheological Properties (Unit: Pa · S) | 400 Pa · s | 427.5 | 422.8 | 431.5 | 314 | 336.5 | 445.1 |
| Settleability (%) | 95% or greater | 97.0 | 96.0 | 95.5 | 97.5 | 97.0 | 93.0 |

As shown in Table 3, the magneto-rheological fluid composition containing non-coated magnetic particles showed different rheological properties depending on the amount of fluid or dispersant, and when the amount of structure stabilizer and dispersant is about 2.0 wt % or greater, effective dispersion of magnetic particles may not be obtained in the aspect of settleability, for example.

As shown in Table 4, as the amount of coated magnetic particles increases, settleability may be improved but rheological properties may be substantially reduced.

Accordingly, the magneto-rheological fluid composition including magnetic particles which is made by mixing non-coated magnetic particles and polyvinyl butyral-coated magnetic particles at the weight ratio of about 1:1 to 4:1 provides optimized magneto-rheological fluid having improved dispersion stability because the magnetic particles are sufficiently dispersed in a fluid and having improved shear stress when external magnetic field is applied.

The magneto-rheological fluid composition of the present invention has advantages that its shear stress is improved when magnetic field is applied, and its settleability or dispersion stability is substantially improved due to optimum range of the coated polyvinyl butyral-coated magnetic particles.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

What is claimed is:

1. A magneto-rheological fluid composition, comprising:
magnetic particles;
a fluid;
a dispersant;
a structure stabilizer; and
an anti-friction additive,
wherein the magnetic particles include non-coated magnetic particles and polyvinyl butyral-coated magnetic particles at the weight ratio of about 1:1 to 4:1.

2. The magneto-rheological fluid composition of claim 1, comprising:
the magnetic particles including the non-coated magnetic particles and the polyvinyl butyral-coated magnetic particles at the weight ratio of 1:1 to 4:1 in an amount of about 55 to 85 wt % based on the total weight of the magneto-rheological fluid composition;
the fluid in an amount of about 10 to 40 wt % based on the total weight of the magneto-rheological fluid composition;
the dispersant in an amount of about 0.1 to 2.0 wt % based on the total weight of the magneto-rheological fluid composition;
the structure stabilizer in an amount of about 0.1 to 2.0 wt % based on the total weight of the magneto-rheological fluid composition; and
the anti-friction additive in an amount of about 1 to 5.0 wt %, based on the total weight of the magneto-rheological fluid composition.

3. The magneto-rheological fluid composition of claim 1, wherein an average particles size of the magnetic particles is of about 1 to 10 μm.

4. The magneto-rheological fluid composition of claim 1, wherein the magnetic particles contain iron (Fe) in an amount of about 97 wt % or greater based on the total weight of the magnetic particles.

5. The magneto-rheological fluid composition of claim 1, wherein the fluid is at least one selected from the group consisting of ester oil, mineral oil, synthetic hydrocarbon oil and silicon oil.

6. The magneto-rheological fluid composition of claim 1, wherein the fluid has kinematic viscosity of about 5 to 50 $m^2/s$ at a temperature of about 40° C.

7. The magneto-rheological fluid composition of claim 1, wherein the dispersant is alkyl ammonium salt.

8. The magneto-rheological fluid composition of claim 1, wherein the structure stabilizer is modified urea.

9. The magneto-rheological fluid composition of claim 1, wherein the anti-friction additive is at least one selected from the group consisting of molybdenum disulfide, zinc phosphate, triaryl phosphate, triphenyl phosphorothionate and amine phosphate.

10. The magneto-rheological fluid composition of claim 1, further comprising an antioxidant, an anticorrosive agent, an antirust agent or combinations thereof.

* * * * *